US007949277B2

(12) United States Patent
Douglas

(10) Patent No.: US 7,949,277 B2
(45) Date of Patent: May 24, 2011

(54) REPROGRAPHIC DEVICE PROVIDING COLLATED AND UNCOLLATED SUBSET FINISHING SELECTIONS AT THE LOCAL GRAPHICAL USER INTERFACE TO ALLOW REPROGRAPHIC DEVICE USERS TO PROGRAM DIFFERENT DOCUMENT FINISHING TYPES WITHIN A SINGLE PRINTED JOB TO CONSTRUCT A MIXED SUBSET FINISHED OUTPUT

(75) Inventor: Wilbert D. Douglas, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 571 days.

(21) Appl. No.: 11/291,664

(22) Filed: Dec. 1, 2005

(65) Prior Publication Data

US 2007/0127942 A1 Jun. 7, 2007

(51) Int. Cl.
*G03G 15/00* (2006.01)

(52) U.S. Cl. ..... 399/81; 399/82; 399/407

(58) Field of Classification Search ..... 399/81, 399/82, 407, 408

See application file for complete search history.

(56) References Cited

U.S. PATENT DOCUMENTS

| | | | | |
|---|---|---|---|---|
| 5,182,796 | A * | 1/1993 | Shibayama et al. | 399/81 X |
| 5,461,469 | A * | 10/1995 | Farrell et al. | 399/407 |
| 6,799,006 | B2 * | 9/2004 | Ohtani | 399/82 |
| 2006/0120782 | A1 * | 6/2006 | Nakamura et al. | 399/405 |

* cited by examiner

*Primary Examiner* — David M Gray
*Assistant Examiner* — Erika Villaluna
(74) *Attorney, Agent, or Firm* — Luis M. Ortiz; Kermit D. Lopez; Tuesday A. Kaasch

(57) ABSTRACT

Reprographic device provides collated and uncollated subset finishing selections at the local Graphical User Interface to allow the user to program different types of finishing within a single job to construct mixed subset finished output. Subset finishing provides a user with the ability to select different finishing options, stapling/folding/offset/hole-punching to a portion of a larger job. Print jobs can make use of software based solutions to create custom print subset finishing. Methods allow different finishing options to be applied to portions of a larger collated or uncollated job from the local GUI. A new group of subset programming attributes can be made available on the local UI. A user can then construct a mixed subset job of both print and scanned images and apply custom finishing operations on each subset. Based on the desired job attributes, the system will automatically acquire image orientation information, select the paper tray source(s), perform image rotation and invoke the appropriate finishing options.

18 Claims, 3 Drawing Sheets

REPROGRAPHIC DEVICE PROVIDING COLLATED AND UNCOLLATED SUBSET FINISHING SELECTIONS AT THE LOCAL GRAPHICAL USER INTERFACE TO ALLOW REPROGRAPHIC DEVICE USERS TO PROGRAM DIFFERENT DOCUMENT FINISHING TYPES WITHIN A SINGLE PRINTED JOB TO CONSTRUCT A MIXED SUBSET FINISHED OUTPUT

TECHNICAL FIELD

The present invention is generally related to reprographic systems and methods reprographic device user subset finishing selections at a graphical user interface associated with a reprographic device. More particularly, the present invention is related to methods providing a reprographic device user with a wider choice of document finishing selections to construct and print mixed subset finished output options coupled with automatic image rotation and automatic input media substrate selection.

BACKGROUND

Reprographic devices are systems that operate as copiers and printers. In general, basic job programming on a reprographic device enables the reprographic device user to produce collated and uncollated sets of printed documents from a single N page input document. These sets are generally defined as follows:

Collated sets are X sets of page(s) [1, 2, 3 . . . N], printing an N page document with Quantity X selected and collation enabled will yield X complete sets of N page(s) each.

Example A: Job with a quantity of 3 having four simplex originals (1, 2, 3, 4) with Simplex and Collation enabled selected would yield:

A Simplex Output set of pages grouped as [1, 2, 3, 4]; [1, 2, 3, 4]; [1, 2, 3, 4,];

Example B: Job with a quantity of 3 having four simplex originals (1, 2, 3, 4) with Duplex and Collation enabled selected would yield:

Duplex Output set of pages grouped as [1/2, 3/4]; [1/2, 3/4]; [1/2, 3/4].

Uncollated stacks (i.e. X duplicates of page 1, (X) duplicates of page 2, (X) duplicates of page N. Printing an N page document with Quantity X selected and Uncollated (collation disabled) will yield X stacks of page 1, X stacks of page 2, . . . and X stacks of page N.

Example C: job with a quantity of 3 having three simplex originals (1, 2, 3) with Simplex and Uncollated selected would yield:

A Simplex Output stack of pages grouped as [1, 1, 1,]; [2, 2, 2]; [3, 3, 3];

Example D: job with a quantity of 3 having four simplex originals (1, 2, 3, 4) with Duplex and Uncollated selected would yield:

Duplex Output stack of pages grouped as [1/2, 1/2, 1/2]; [3/4, 3/4, 3/4].

Workflow software can offer a reprographic device user with a limited set of print job programming attributes, by way of the local UI, for collated or uncollated jobs. These attributes enable a single copy or print job resident on the system to be subdivided and printed with the same type of finishing applied to each subset.

What can be termed "Build Job" is software operable in some photocopiers that enables a user to scan (i.e. copy) documents in separate chunks, electronically collect and collate those scans before producing the printed output. Build Job is applicable to scan jobs and does not apply to print jobs. Build Job software does not support mixed subset finishing.

Subset finishing allows the user to program different types of finishing within a single job. In most systems, subset finishing can only be programmed in PostScript using the setpage device operator or by using the Variable Data Intelligent PostScript Printware (VIPP) or a subset-finishing command set offered on DocuTech copiers manufactured and sold by XEROX Corporation.

The limitation with current methods and system is that reprographic device users lack management over complex functions for mixed document print jobs including image orientation, output orientation, and staple control to give the reprographic device user what they desire as output on the first try.

Another problem with current methods and system is that waste is caused by experimental "cut and try" operations that are undertaken by reprographic device users before the proper mixture of system elements is found.

The problem with current methods and system is that they are unable to determine the proper image rotation which forces substrate orientation selections and finishing setup, especially where mixed documents are concerned.

What is needed are print systems and associated software methods improvements that eliminate the need of reprographic device users to scan documents from the document feeder or the manual document glass in separate chunks, and electronically collect and collate those scans before producing a single printed document output.

SUMMARY

The following summary of the invention is provided to facilitate an understanding of some of the innovative features unique to the present invention and is not intended to be a full description. A full appreciation of the various aspects of the invention can be gained by taking the entire specification, claims, drawings, and abstract as a whole.

The present invention eliminates the need to scan documents from the document feeder or the manual document glass in separate chunks, and to electronically collect and collate those scans before producing the printed output.

An improved reprographic device provides collated and uncollated subset finishing selections at the local Graphical User Interface (GUI) to allow the user to program different types of finishing within a single job to construct mixed subset finished output.

Accordingly, it is a feature of the embodiment to provide users of a reprographic device with the ability to program different types of finishing within a single job from the local GUI for collated and uncollated jobs.

According to another feature, subset programming attributes provide capabilities for the user to construct mixed subset finished output from a single N page input document that is acquired from at least one of a copy job or job ticket resident on the system.

According to another feature attributes, conveniently available at the local UI, enable construction of stack output that contains mixed subset finishing, variable subset page ranges, variable subset page duplication, variable subset media selection and variable subset offset. It enables the user to combine both finished and unfinished subsets in a single stack output.

According to another feature, subset functionality combines UI selection, input original orientation of Long Edge Feed (LEF), or Short Edge Feed (SEF), manages the system's image rotation before marking and selects the correct paper feed tray media orientation of LEF or SEF to construct stack output containing mixed subset finishing treatment.

It is another feature of the present embodiment to provide a reprographic device user the management over complex functions including image orientation, output orientation, and staple control to give the reprographic device user what they desire as output on the first try.

It is yet another feature of the present embodiment to eliminate waste caused by experimental "cut and try" operations that are undertaken by reprographic device users before the proper mixture of system elements is found.

BRIEF DESCRIPTION OF THE DRAWINGS

The accompanying figures, in which like reference numerals refer to identical or functionally-similar elements throughout the separate views and which are incorporated in and form part of the specification, further illustrate embodiments of the present invention.

DETAILED DESCRIPTION OF EMBODIMENTS

The particular values and configurations discussed in these non-limiting examples can be varied and are cited merely to illustrate an embodiment of the present invention and are not intended to limit the scope of the invention.

Figure 1:
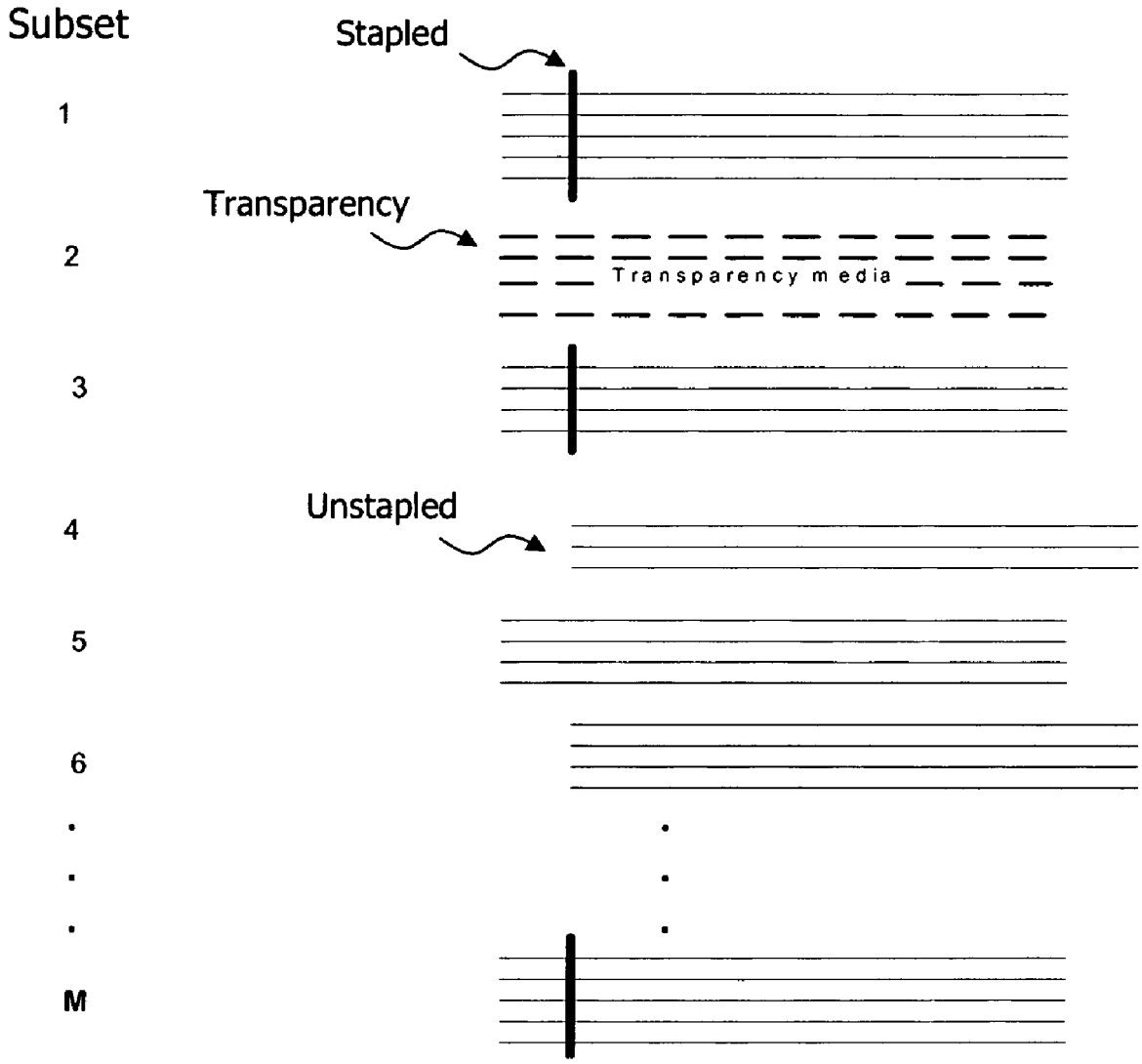
FIG. 1 illustrates a depiction of 1 through M subsets comprising of mixed stacked inputs.

The system and methods of the present embodiment provide users of a reprographic device with the ability to program different types of finishing within a single job from a reprographic device's local GUI for collated and uncollated print jobs. Referring to FIG. 1, an example is shown wherein finishing types can be programmed in any order and in any combination within a job to enable construction of a mixed stack output. For example, subset 1 is shown in FIG. 1 as a stapled short feed document, while subset 4 is an unstapled long fed document. Subset 2 is shown in FIG. 1 as a transparency-related document.

Figure 2:
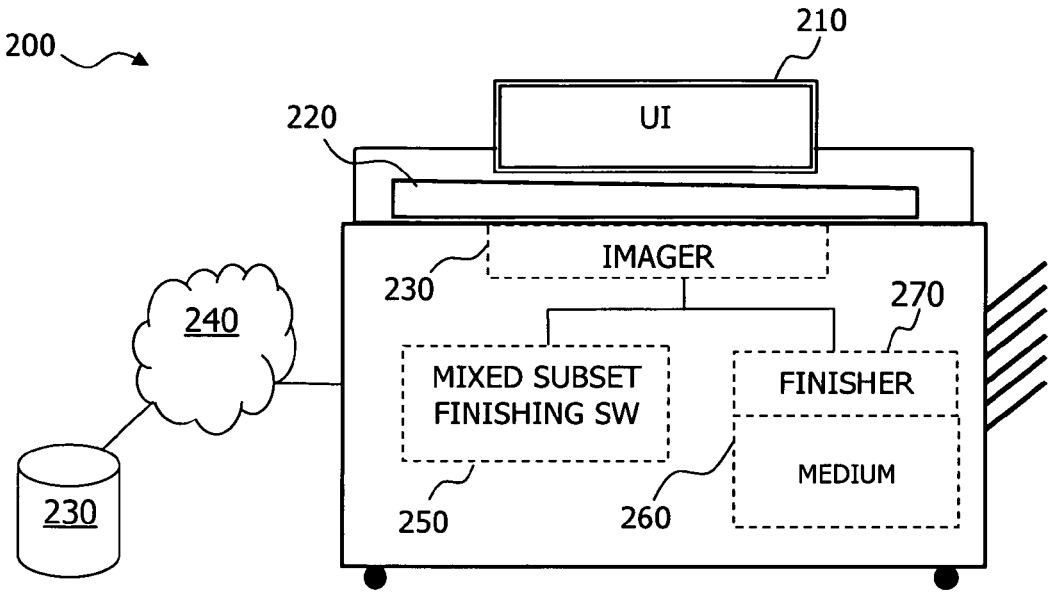
FIG. 2 illustrates a system in accordance with features of the present embodiments.

Referring to FIG. 2, a reprographic system 200 adapted for carrying out methods of the present invention at the direction of a reprographic device user is shown. The reprographic device 200 includes a graphical user interface (UI) 210, a document scanner/feeder 220, an imager 230, a finisher 270 with access to medium trays 260. The reprographic device further includes mixed subset finishing software 250, which together with the graphical user interface 210 enables a graphical device user to carry out methods of the embodiment. Mixed documents can be provided to the reprographic device 200 from the feeder 200 and imager 230 and/or from a remote database 230 via a network connection 240 to the reprographic device. Documents may also be provided to the reprographic device locally via a portable memory medium (e.g., disk, not shown).

Subset programming attributes provide capabilities for the user to construct mixed subset finished output from a single N page input document that is acquired from a copy job (e.g., via a reprographic device scanner) or job ticket (e.g., a print job request to a reprographic device) resident on the system. If the user intends to make mixed finished subsets with variable subset finishing, variable pages per subsets and variable subset media, then the user can now select a single N page residential Copy or Print job and select subset job programming attributes at the local reprographic device GUI during job submission. When the mixed subset finished job is submitted, the system will automatically construct and print the desired output.

As will be appreciated from the inventor's teaching, subset functionality can combine UI selection, input original orientation of Long Edge Feed (LEF), or Short Edge Feed (SEF), manages the system's image rotation before marking and selects the correct paper feed tray media orientation of LEF or SEF, to construct stack output containing mixed subset finishing treatment. This is an improvement in a finishing system that eliminates the need to manually scan documents in separate chunks and electronically collect and collate those scans before producing the printed output.

A reprographic device user can select mixed subset Finishing and subset offset using the job programming attributes for collated and uncollated stacks using a printing system configured with a graphical user interface.

When Subset Finishing is selected, the user can select:

a) Specific consecutive sheets within a job to define the subsets.
b) Any available finishing option for each individual sub-set. The user can combine both finished and unfinished subsets in the job output
c) Subset offset for each individual sub-set.
d) Select individual subset media on a subset basis.

As examples, the following finishing types can be programmed to operate on a printing system for collated and uncollated print stacks. The type of finishing is limited to finisher devices that are attached to the printing system. Uncollated mixed subset finishing can also be provided an enhanced programming tool on the local UI for pad printing. Typical Kinds of pad printing include Blank Pad, Note Pad, Shopping Pad, Steno Pad, Legal Pad, Phone Pads, Advertising Pad, and Engineering Pad.

Subset stapling with variable page range [a-b] for collated or page (Y) for uncollated, up to sheet capacity of the stapler, and one of the following options:

No Staple (default)

Single Staple Position (1 staple at any of 4 corners of the subset):

Portrait Left
Portrait Right
Landscape Left
Landscape Right

Dial Staple Position (2 staples on any of 4 sides of the subset):

Left Side Portrait
Right Side Portrait
Top Portrait
Bottom Portrait
Left Side Landscape
Right Side Landscape
Top Landscape
Bottom Landscape Subset Offset with variable page range [c-d] or page (Y) for uncollated, and one of the following options:

No offset (default)
Each subset

Subset Fold with variable page range [e-f] or page (Y) for uncollated, and one of the following options:

No fold (default)
C Tri-Fold
Z Tri-Fold
Booklet Fold unstitched

Booklet Fold stitched

Subset Hole Punch with variable page range [g-h] or page (Y) for uncollated, and one of the following options:

No Hole Punch (default)

2 hole 3 hole 4 hole

Subset Output Location with variable page range [l-j] or page (Y) for uncollated, and one of the following options:

Top tray

Stacker

External finishers

Figure 3:
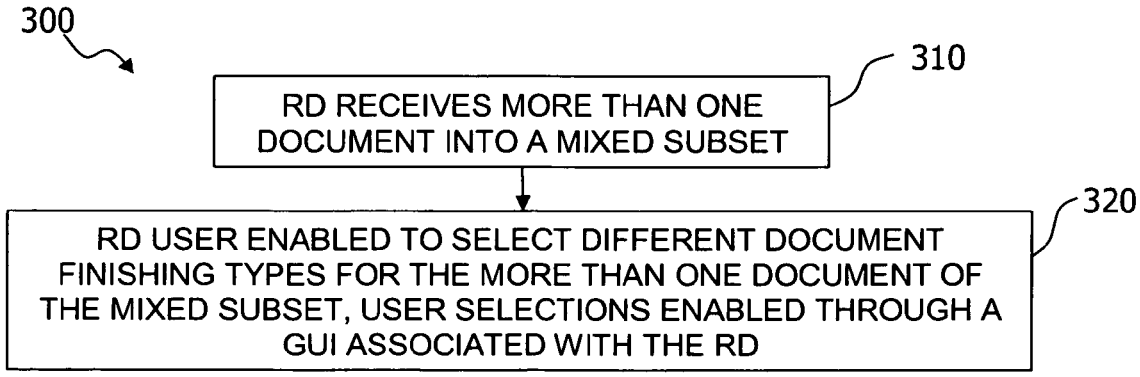
FIG. 3 illustrates a flow diagram in accordance with carrying out a method in accordance with the embodiments.

Referring to FIG. 3, a flow diagram 300 of methods steps taken by a user of a reprographic device to process mixed documents is illustrated. As shown in step 310, a reprographic device receives more than one document into a mixed subset. As shown in step 320, a reprographic device user is enabled to select different document finishing types for the more than one document of the mixed subset. The user selections are enabled through a graphical user interface associated with the reprographic device.

Figure 4:
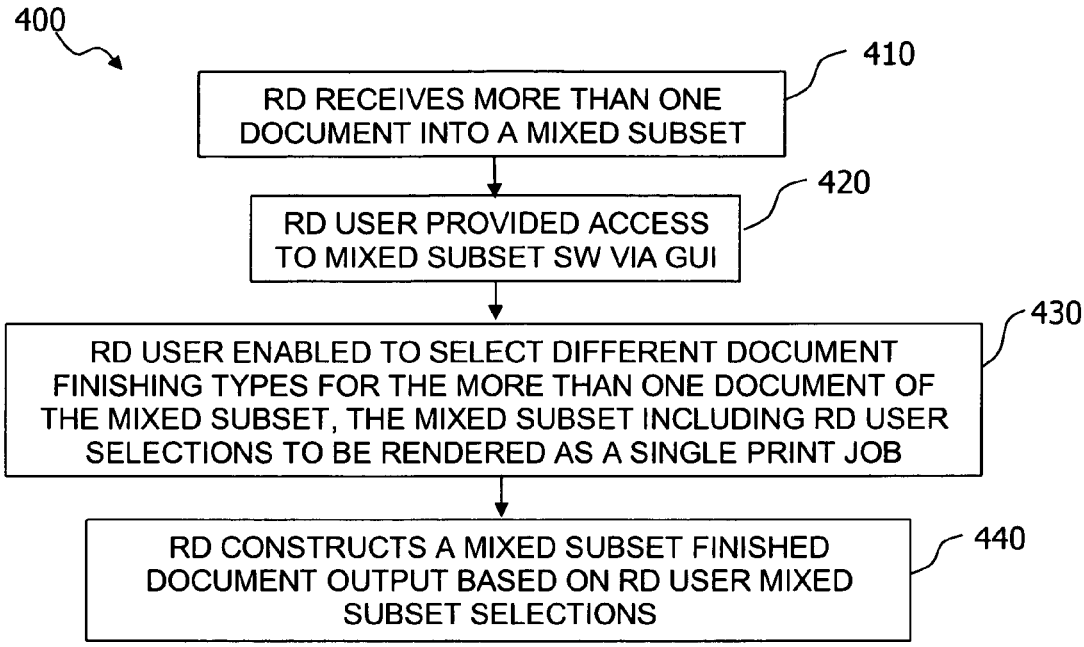
FIG. 4 illustrates a flow diagram in accordance with carrying out a method in accordance with the embodiments.

Referring to FIG. 4, another flow diagram 400 of method steps taken by a user of a reprographic device to process mixed documents is also illustrated. Referring to step 410, a reprographic device received more than one document into a mixed subset. In step 420 it is shown that a reprographic device user is provided access to mixed subset software via a GUI associated with the reprographic device. As shown in step 430, the reprographic device user is enabled to select different document finishing types for the more than one document of the mixed subset; the mixed subset including reprographic device user selection to be rendered as a single print job. As shown in step 440, the reprographic device constructs a mixed subset finished document output based on the reprographic device user's mixed subset selections.

What follows are specific examples of how a reprographic device user can select mixed subset finishing and subset offset using the job programming attributes for collated and uncollated stacks using a printing system configured with a graphical user interface.

Collated Stacks

As specifically applied to collated stacks (e.g., Quantity (X) of any page range in the N page input document), a reprographic device user can define a desired quantity (X) of any page range in the N page input document and combine it with mixed subset finishing and subset offset. Examples 1 and 2 described below illustrate the ability for a reprographic device user to select "Variable Subset Options" at the GUI. Variable subset options can be programmed and applied on a subset basis. Example 3 illustrates how selecting the "Fixed Subset Options" can cause the choice for subset finishing and subset offset to be applied to each subset. As can be appreciated from the following examples, the reprographic device user can choose various finishing options for mixed document collated jobs:

Example 1

Variable Subset Page Range, Mixed Finishing and Offset for Each Subset

A user intends to use a 28 Page File to construct 500 mixed subset finished presentation folders and would like to create the following output for each folder:

Pages 1-4 Single Portrait Staple, quantity 3, offset

Pages 5-8 Transparency media, quantity 1, no offset

Pages 9-12 Dual Portrait Staple, quantity 3, no offset

Pages 13-16 Stacker, Dual Top Landscape, quantity 9, offset (used for handouts)

Pages 17-28 Single Landscape Staple, quantity 1, no offset

Then the user can submit a single 28-page copy job, or modify a job ticket, with the following job programming attributes selected:

(1) Programmed job quantity: 500 copies and
(2) Collated with Variable subset and
(3) Subset1 Pages=1-4 and
(4) Subset1 Finishing=Single Portrait Left Staple, and
(5) Subset1 Offset=yes, and
(6) Subset1 quantity=3 and
(7) Subset2 Pages=5-8 and
(8) Subset2 Finishing=no, and
(9) Subset2 Paper Stock=transparency, and
(10) Subset2 Offset=no, and
(11) Subset2 quantity=1 and
(12) Subset3 Pages=9-12 and
(13) Subset3 Finishing=Dual Left Side Portrait Staple, and
(14) Subset3 Offset=no, and
(15) Subset3 quantity=3 and
(16) Subset4 Pages=13-16 and
(17) Subset4 Finishing=Dual Top Landscape Staple, and
(18) Subset4 Offset=yes, and
(19) Subset4 quantity=9 and
(20) Subset5 Pages=17-28 and
(21) Subset5 Finishing=Single Landscape Left Staple, and
(22) Subset5 Offset=no, and
(23) Subset5 quantity=1

Example 2

100 Page job with separate stack output. A user intends to use a 100 Page File to construct mixed subset finished output and have separate output stacks. The following output is desired for this job:

Pages 1-30 Single Portrait Staple

Pages 31-50 Top Tray

Pages 51-100 Bind

Then the user can submit a single 100 page copy job, or modify a job ticket, with the following job programming attributes selected:

(1) Programmed job quantity: 1 copies and
(2) Collated with Variable subset and
(3) Subset1 Pages=1-30 and
(4) Subset1 Finishing=Single Portrait Left Staple, and
(5) Subset1 Offset=no, and
(6) Subset1 quantity=1 and
(7) Subset2 Pages=31-50 and
(8) Subset2 Destination=Top Tray, and
(9) Subset2 quantity=1 and
(10) Subset3 Pages=51-100 and
(11) Subset3 Finishing=External Finisher, and
(12) Subset3 Offset=no, and
(13) Subset3 quantity=1

Example 3

For Each Subset, Fixed Subset Quantity, Subsets Stapled and No Offset

A user intends to subdivide a 70 page job into 7 landscape stapled subsets, for handouts, consisting of 10 pages per handout, and then the user would submit a 70 page copy job, or a job ticket with the following job programming attributes selected:

(1) Programmed job quantity: 1 copies and (2) Collated and
(3) Landscape stapling and
(4) Fixed subset options and
(5) Subset Finishing=yes, and
(6) Subset Offset=no, and
(7) Subset quantity=10 pages Uncollated Stacks As specific applied to uncollated stacks (e.g., Quantity (X) of any number of original (N), a reprographic device user can define a desired quantity (X) duplicates of page (Y) in the N page input document and combine it with mixed subset finishing and subset offset. Examples 4-6 illustrate the ability to select "Variable Subset Options" at the GUI. In examples 4-6 variable subset options can be programmed and applied on a subset basis. Examples 7 and 8 illustrate how selecting the "Fixed Subset Options" would cause the choice for subset finishing and subset offset to be applied to each subset.

Example 4

A user intends to use a one Page File to construct 500 Phone Message Pads with 100 sheets in each pad on 5"×7", Pink paper stock, then the user would submit a single-page copy job, or select a job ticket, and program the following job programming attributes:
(1) Programmed job quantity: 500 copies and
(2) UnCollated with Variable subset and
(3) Subset1 Page=1 and
(4) Subset1 Finishing=Dual Top Portrait Stapled, and
(5) Subset1 Offset=no, and
(6) Subset1 Paper Stock=5"×7" Pink, and
(7) Subset1 quantity=100 and Example 5

A user intends to use a 4 Page File to construct 3000 pad sets with 4 pads per set and 50 sheets in each pad, each pad is produced with a different 4"×5" *media*:

Page 1 Bind, 4"×5" white stock, quantity 50, no offset
Page 2 Bind, 4"×5" yellow stock, quantity 50, no offset
Page 3 Bind, 4"×5" green stock, quantity 50, no offset
Page 4 Dual Top Landscape Stapled, 4"×5" custom 1 stock, quantity 50, no offset Then the user can submit a single 4-page job with the following job programming attributes selected:
(1) Programmed job quantity: 3000 copies and
(2) UnCollated with Variable subset and
(3) Subset1 Page=1 and
(4) Subset1 Paper Stock=4"×5" white, and
(5) Subset1 Finishing=Bind, and
(6) Subset1 Offset=no, and
(7) Subset1 quantity=50 and
(8) Subset2 Page=2 and
(9) Subset2 Finishing=Bind, and
(10) Subset2 Offset=no, and
(11) Subset2 Paper Stock=4"×5" yellow, and
(12) Subset2 quantity=50 and
(13) Subset3 Page=3 and
(14) Subset3 Finishing=Bind, and
(15) Subset3 Offset=no, and
(16) Subset3 Paper Stock=4"×5" green, and
(17) Subset3 quantity=50 and
(18) Subset4 Page=4 and
(19) Subset4 Finishing=Dual Top Landscape Stapled, and
(20) Subset4 Offset=no, and
(21) Subset4 Paper Stock=4"×5" custom 1, and
(22) Subset4 quantity=50

Example 6

A user intends to use a 2 Page File to construct 200 pad sets with 2 pads per set and variable number of sheets in each pad.

Page 1 Dual Top Portrait Stapled, quantity 25, no offset
Page 2 Custom Finished, quantity 75, with offset Then the user can submit a single 2-page job with the following job programming attributes selected:
(1) Programmed job quantity: 200 copies and
(2) UnCollated with Variable subset and
(3) Subset1 Page=1 and
(4) Subset1 Finishing=Dual Top Portrait Stapled, and
(5) Subset1 Offset=no, and
(6) Subset1 quantity=25 and
(7) Subset2 Page=2 and
(8) Subset2 Finishing=External Finisher, and
(9) Subset2 Offset=yes, and
(10) Subset2 quantity=75

Example 7

Each Subset, Fixed # Sheets/Subset, Stapled and No Offset

Job contains one input page to make note Pads on 4"×6" media. Note: This uncollated subset finishing example exists today.

If the user intends to make 10 dual portrait stapled notepads consisting of 50 pages per notepad, then the user would submit a single page original with the following job programming attributes selected (total printed pages=500):
(1) Programmed job quantity: 500 copies and
(2) Uncollated and
(3) Paper Stock=4"×6" media and
(4) Dual portrait stapling and
(5) Subset Finishing=yes, and
(6) Subset Offset=no, and
(7) Subset quantity=50 pages Example 8

Uncollated Subset offsetting. The user has an option to specify Subset offsetting with no finishing at job submission for uncollated jobs. For example: If a user intends to make 10 dual portrait stapled notepads consisting of 50 pages per notepad, then the user would submit a single page original with the following job programming attributes selected:
(1) Programmed job quantity: 500 copies and
(2) Uncollated and
(3) Dual portrait stapling and
(4) Subset Offset=yes, and
(5) Subset quantity=50 pages It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. Method enabling reprographic device user selection of various document finishing selections for more than one document to be rendered as a single print job from a reprographic device including mixed subset software, the method comprising the steps of:

receiving more than one document into a reprographic device as a mixed subset, wherein said reprographic device includes a software module configured to support mixed subset finishing;

enabling a reprographic device user to select any number of different document finishing attributes in any order and in any combination for the more than one document comprising the mixed subset, said selection enabled through a graphical user interface associated with the reprographic device, wherein said document finishing attributes include collate, media size, media material, number of staples, staple position, offset, fold, hole punch, number of holes, and position of hole punch; and enabling the user to combine finished and unfinished subsets in a single stack output.

2. The method of claim 1, wherein one reprographic device user selection includes selection of a document input source.

3. The method of claim 1, wherein one reprographic device user selection includes image orientation, wherein original orientation of documents received by the reprographic device can be Long Edge Feed (LEF) and Short Edge Feed (SEF) and orientation of source input paper substrate located within paper medium trays associated with the reprographic device are also loaded in either Long Edge Feed (LEF) and Short Edge Feed (SEF) orientation.

4. The method of claim 1, wherein one reprographic device user selection includes stapling number and location.

5. The method of claim 1, wherein one reprographic device user selection includes more than one paper medium source.

6. The method of claim 1 wherein the reprographic device automatically determines requirements from iconic subset finishing information after the step of receiving more than one document into a reprographic device as a mixed subset.

7. The method of claim 1 further comprising the step of enabling the reprographic device to render a mixed subset document output based on the reprographic device user selections.

8. The method of claim 7, wherein one reprographic device user selection includes document input source.

9. The method of claim 7, wherein one reprographic device user selection includes image orientation, wherein original orientation of documents received by the reprographic device can be Long Edge Feed (LEF) and Short Edge Feed (SEF) and orientation of source input paper substrate located within paper medium trays associated with the reprographic device are also loaded in either Long Edge Feed (LEF) and Short Edge Feed (SEF) orientation.

10. The method of claim 7, wherein one reprographic device user selection includes stapling number and location.

11. The method of claim 7, wherein one reprographic device user selection includes more than one paper medium source.

12. The method of claim 7 wherein the reprographic device automatically determines requirements from iconic subset finishing information after the step of receiving more than one document into a reprographic device as a mixed subset.

13. The method of claim 1 wherein the reprographic user is enabled to select different document finishing attributes via access to mixed subset software and a graphical user interface associated with the reprographic device.

14. The method of claim 13, wherein one reprographic device user selection includes document input source.

15. The method of claim 13, wherein one reprographic device user selection includes image orientation, wherein original orientation of documents received by the reprographic device can be Long Edge Feed (LEF) and Short Edge Feed (SEF) and orientation of source input paper substrate located within paper medium trays associated with the reprographic device are also loaded in either Long Edge Feed (LEF) and Short Edge Feed (SEF) orientation.

16. The method of claim 13, wherein one reprographic device user selection includes stapling number and location.

17. The method of claim 13, wherein one reprographic device user selection includes more than one paper medium source.

18. The method of claim 13 wherein the reprographic device automatically determines requirements from iconic subset finishing information after the step of receiving more than one document into a reprographic device as a mixed subset.

* * * * *